US006752649B2

(12) United States Patent
Arkin et al.

(10) Patent No.: US 6,752,649 B2
(45) Date of Patent: Jun. 22, 2004

(54) ILLUMINATED INDICIA POWER SUPPLY APPARATUS AND METHOD OF MANUFACTURE

(75) Inventors: David M. Arkin, Glenview, IL (US); Michael Knapp, Mundelien, IL (US)

(73) Assignee: Xentris, LLC, Addison, IL (US)

( * ) Notice: Subject to any disclaimer, the term of this patent is extended or adjusted under 35 U.S.C. 154(b) by 0 days.

(21) Appl. No.: 10/065,675

(22) Filed: Nov. 7, 2002

(65) Prior Publication Data

US 2004/0092156 A1 May 13, 2004

(51) Int. Cl.[7] ..... H01R 3/00
(52) U.S. Cl. ..... 439/491
(58) Field of Search ..... 439/491, 490, 439/910, 488, 608; D13/144

(56) References Cited

U.S. PATENT DOCUMENTS

| | | | | |
|---|---|---|---|---|
| 1,258,590 | A | | 3/1918 | Meyer |
| 2,954,544 | A | | 9/1960 | Focosi |
| 3,099,505 | A | | 7/1963 | Schwartz |
| 3,947,985 | A | | 4/1976 | Skrzypczak |
| 3,992,872 | A | | 11/1976 | Stanish |
| 4,322,122 | A | | 3/1982 | Schwartz |
| 4,556,932 | A | | 12/1985 | Lehrer et al. |
| 4,606,141 | A | | 8/1986 | Murray |
| 4,922,223 | A | | 5/1990 | Prevot |
| 5,131,869 | A | | 7/1992 | Wharton |
| 5,201,677 | A | | 4/1993 | Takayama |
| 5,203,255 | A | | 4/1993 | Wells et al. |
| 5,230,641 | A | | 7/1993 | Wharton |
| 5,412,887 | A | | 5/1995 | Layne |
| 5,431,585 | A | * | 7/1995 | Fan ..... 439/668 |
| 5,569,053 | A | | 10/1996 | Nelson |
| 5,690,509 | A | * | 11/1997 | Eisenbraun ..... 439/490 |
| 5,697,175 | A | | 12/1997 | Schwartz |
| 5,775,952 | A | | 7/1998 | Lu |
| 5,803,581 | A | | 9/1998 | Brockman |
| 5,965,623 | A | | 10/1999 | Maher |
| 6,140,934 | A | * | 10/2000 | Lam ..... 340/815.4 |
| 6,336,825 | B1 | * | 1/2002 | Seefried ..... 439/488 |
| 6,364,273 | B1 | | 4/2002 | Otema |
| 6,368,157 | B1 | | 4/2002 | Bottazzi |

* cited by examiner

*Primary Examiner*—Ross Gushi
(74) *Attorney, Agent, or Firm*—Babcock IP, LLC

(57) ABSTRACT

A power supply apparatus for coupling electricity between a power source and a device. The apparatus including a body having at least one aperture and at least one electrical contact configured to mate with the power source; at least one light source arranged within the body; and at least one light transmitting cover. The cover configured to cover the at least one aperture. The cover having indicia thereon. The at least one light source arranged to radiate through the at least one aperture and backlight the indicia. Manufacture of the power supply apparatus may be performed in large volumes and desired indicia later added and or changed via the cover, increasing manufacturing efficiency and flexibility.

2 Claims, 3 Drawing Sheets

ILLUMINATED INDICIA POWER SUPPLY APPARATUS AND METHOD OF MANUFACTURE

BACKGROUND OF INVENTION

1. Field of the Invention

The invention generally relates to a power supply apparatus. Specifically, the invention relates to a power supply apparatus with illuminated indicia capability useful, for example, for displaying brand and or advertising information.

2. Description of Related Art

A power supply apparatus may be used to couple an electrical device to an electrical power source. The cigarette lighter/12 Volt power socket found in most consumer vehicles has become a standard electrical power source usable with power supply apparatus for many mobile devices, for example, cellular telephones and or portable computers. A power supply apparatus in the form of a cigarette lighter adapter (CLA) may be configured to mate with the cigarette lighter/12 Volt power socket to supply electrical current to a desired device. The electrical current may be used, for example, to operate the device and or charge a battery therein.

The cigarette lighter/12 Volt power socket is typically located for easy access by the vehicle operator, i.e. it is located in plain view of the operator and or other vehicle occupants. CLAs may include a light emitting diode (LED), incandescent lamp or other low power consumption light source that illuminates upon insertion into the cigarette lighter/12 Volt power socket to provide visual feedback indicating that an electrical connection has been made and or that electrical power is present.

Manufacturers/sellers of electrical devices, services and their accessories, for example cellular telephone service providers, compete within their market segments, often offering identical hardware. In an attempt to increase sales and profitability by differentiating themselves from their competition, manufacturers/sellers seek and are willing to pay a premium for opportunities to build brand recognition and consumer goodwill.

A power supply apparatus manufacturer seeking to increase manufacturing efficiency may offer the same power supply apparatus configuration to multiple electrical device manufacturers/sellers on an original equipment manufacturer (OEM) basis. Extra costs related to OEM sales may include, for example, extra design and manufacturing steps required for adding individual branding for each different customer. Also, there is a chance that an OEM sale will be canceled prior to delivery, leaving the manufacturer with an inventory of power supply apparatus that may not be profitably resold due to the presence of the canceling customer's irremovable branding upon the power supply apparatus.

Therefore, it is an object of the invention to provide a method and apparatus that overcomes deficiencies in the prior art.

BRIEF DESCRIPTION OF DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Figure 1:
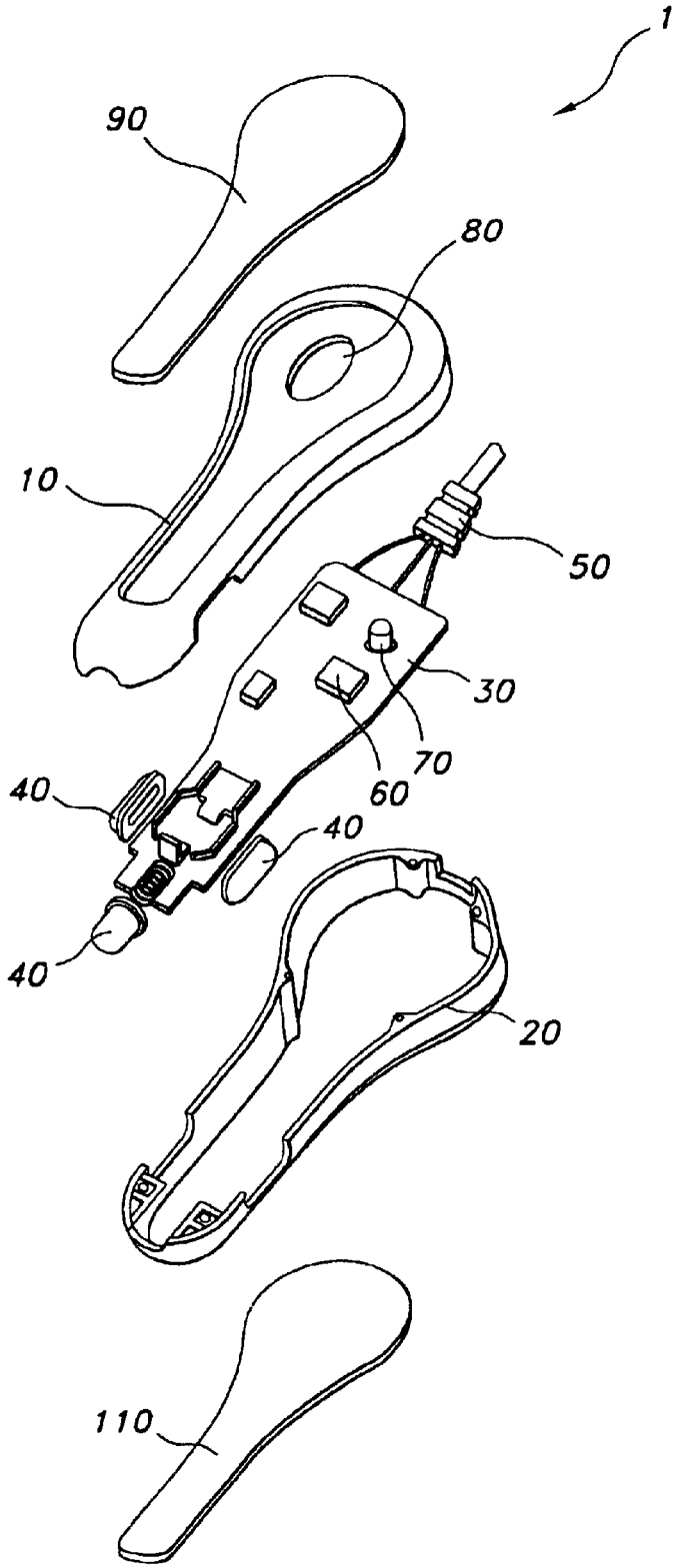
FIG. 1 is an exploded isometric view of a CLA, according to the invention.
Figure 2:
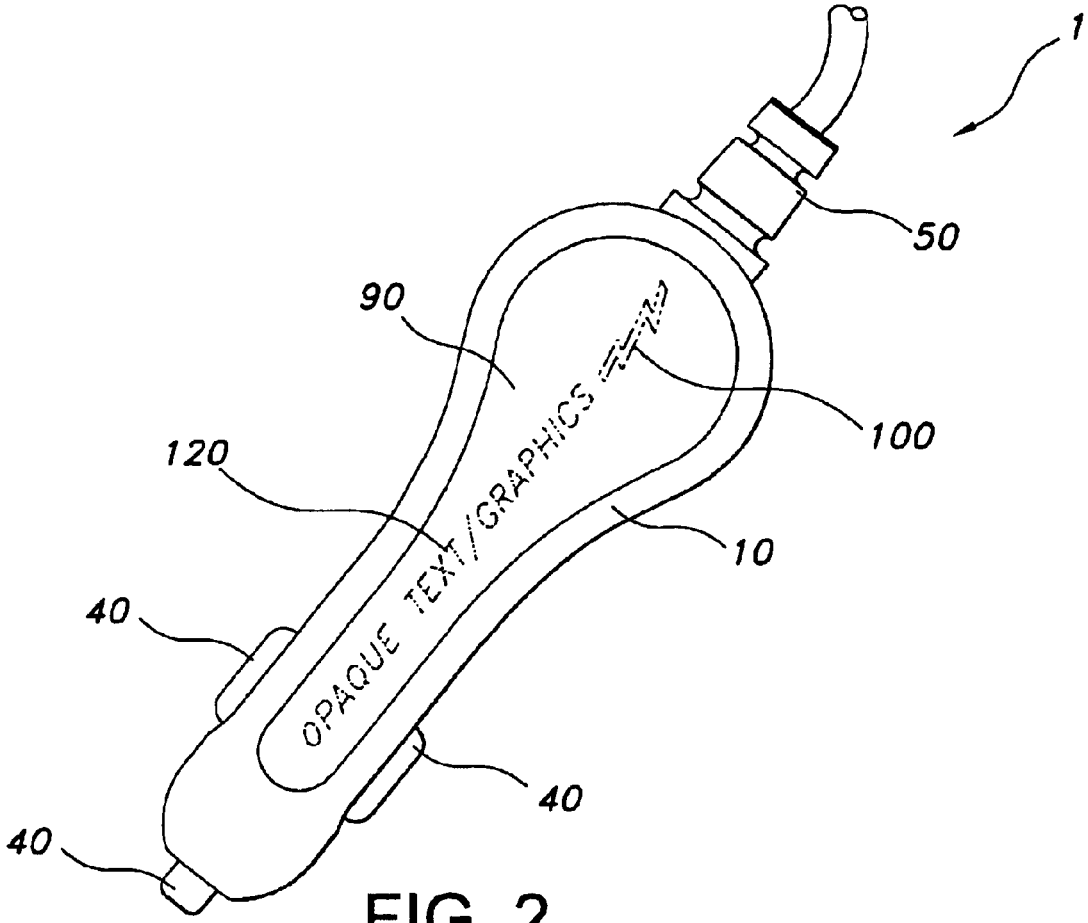
FIG. 2 is a top view of of the CLA shown in FIG. 1.

One embodiment of the invention, a power supply apparatus in the form of a CLA, is shown in FIGS. 1 and 2. The CLA 1 is formed from a pair of, for example, molded and or stamped top body 10 and bottom body 20 portions which mate together or with additional bodies/elements to form a male plug adapted to couple with a cigarette lighter/12 Volt socket.

Figure 3:
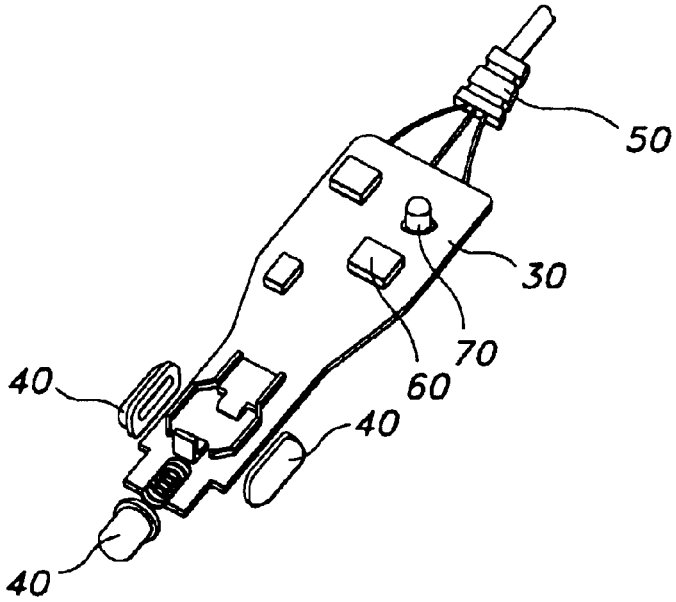
FIG. 3 is a top view of a CLA printed circuit board (PCB).

As shown in FIG. 3, a PCB 30 configured to be located inside the plug may be used to couple electrical contactors 40 with an electrical cable 50 via, for example, voltage/current regulating/conditioning and or overload protection circuitry 60 that may be located on the PCB 30. The electrical contactors 40 are arranged to protrude from the plug and contact mating surfaces of the socket. Also located on the PCB 30 is one or more light sources, for example a light emitting diode (LED) 70 or incandescent lamp. If the circuitry 60 is unnecessary/undesired, the PCB 30 may be omitted and the LED 70 or other light source attached to and or between the electrical contactors 40, within the plug. The at least one LED 70 or other light source may be configured to energize when the CLA 1 is coupled with a power source.

The CLA 1 configuration described herein above is a generic example of a power supply apparatus. Other power supply apparatus may be easily adapted, within the scope of the invention, into a wide range of variations and configured for different electrical power levels, sources and or receptacles by one skilled in the art.

Figure 4:
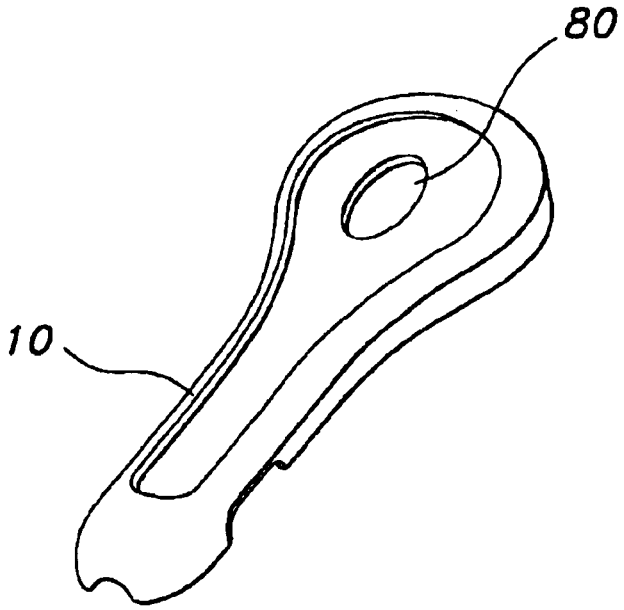
FIG. 4 is a top view of the top housing half.
Figure 5:
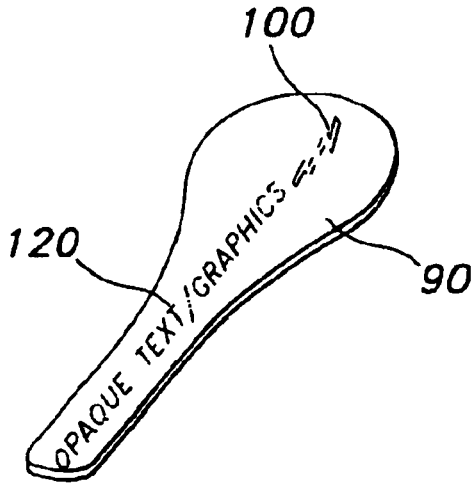
FIG. 5 is a top view of a cover.

Illuminated indicia useful, for example, for branding, instructional indicia or advertising may be added to the CLA 1 or other form of power supply adapter by providing at least one aperture 80 in the top body 10, as shown in FIG. 4, and or bottom body 20 through which the light emitted by the at least one LED 70 or other light source may radiate. As shown in FIG. 5, a top cover 90 formed from a light transmitting material, for example plastic, acrylic or polycarbonate is configured to attach to the top body 10, covering the at least one aperture 80.

Translucent indicia 100 printed on or otherwise applied to a, for example, backside of the top cover 90 and or bottom cover 110 may be located where it will be backlit by the light emitted from LED 70 that passes through the at least one aperture 80. Other indicia 120 may be printed or otherwise applied to the top cover 90 in an opaque covering, ink or paint and the translucent indicia highlighted/defined by being surrounded with a similarly applied opaque field 130 covering areas of the, for example, backside of the top cover 90 were light passage/backlighting is not desired.

The at least one LED 70 may be two or more LEDs 70, located on each side of the PCB 30. Alternatively, a single LED 70 may be mounted at an edge of or hole in the PCB 30, allowing light from the single LED 70 to backlight translucent indicia 100 on both the top cover 90 and bottom cover 110. Alternatively, a light pipe may be used to route light to one or more of the translucent indicia 100 on the top cover 90 and or bottom cover 110.

The top cover 90 and bottom cover 110 may be attached to the top body 10 and bottom body 20 respectively by, for example, one or more pins mating to sockets, a retaining lip/edge formed in the cover(s) and or use of a suitable adhesive. A non-permanent attachment may be desirable, requiring only the top cover 90 and or bottom cover 110 to be exchanged as the desired translucent indicia 100 and or other indicia 120 thereon is modified.

As described, the invention provides an illuminated branding, instructional indicia or advertisement (for example, corporate logos, trade or service marks) surface on a power supply apparatus. In a vehicle CLA embodiment, the backlit indicia may be readily viewable by the user whenever the CLA is energized, resulting in highly desirable repeated impressions of the indicia upon the user. The invention allows for efficient large volume manufacturing and assembly of the power supply apparatus and later customer specific product customization for individual, for example OEM, orders by adding one or more covers having custom indicia. The indicia may be modified as desired, simply by exchanging the top and or bottom covers.

Table of Parts

| | |
|---|---|
| 1 | cigarette lighter adapter power supply |
| 10 | top body |
| 20 | bottom body |
| 30 | printed circuit board |
| 40 | electrical contractor |
| 50 | electrical cable |
| 60 | circuitry |
| 70 | light emitting diode |
| 80 | aperture |
| 90 | top cover |
| 100 | translucent indicia |
| 110 | bottom cover |
| 120 | other indicia |
| 130 | opaque field |

Where in the foregoing description reference has been made to ratios, integers, components or modules having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

What is claimed is:

1. A power supply apparatus for coupling electricity between a power source and a device, comprising:

a body having at least one aperture and at least one electrical contact configured to mate with the power source;

at least one light source arranged within the body; and at least one removable light transmitting cover, configured to cover the at least one aperture, having indicia thereon;

the at least one light source arranged to radiate through the at least one aperture and backlight the indicia;

the at least one light source is mounted at one of an edge of the printed circuit board and an aperture in the printed circuit board, whereby a light output of the at least one light source projects to a first side and a second side of the printed circuit board.

2. A power supply apparatus for coupling electricity between a power source and a device, comprising:

a body having at least one aperture and at least one electrical contact configured to mate with the power source;

at least one light source arranged within the body;

at least one removable light transmitting cover, configured to cover the at least one aperture, having indicia thereon; and a light pipe;

the light pipe located to redirect light from the at least one light source to backlight the indicia.

* * * * *